US007371293B2

(12) United States Patent
Nakashima et al.

(10) Patent No.: US 7,371,293 B2
(45) Date of Patent: May 13, 2008

(54) COLD FINISHED SEAMLESS STEEL TUBES

(75) Inventors: Takashi Nakashima, Wakayama (JP); Kouichi Kuroda, Takatsuki (JP); Kenichi Beppu, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 508 days.

(21) Appl. No.: 11/039,954

(22) Filed: Jan. 24, 2005

(65) Prior Publication Data

US 2005/0191509 A1 Sep. 1, 2005

(30) Foreign Application Priority Data

Feb. 5, 2004 (JP) ..... 2004-029520

(51) Int. Cl.
*C22C 38/18* (2006.01)
*C22C 38/00* (2006.01)
*C21D 8/10* (2006.01)

(52) U.S. Cl. ..... 148/333; 148/320; 148/334; 148/335; 148/593

(58) Field of Classification Search ..... 148/320–337, 148/909, 590–598
See application file for complete search history.

(56) References Cited

FOREIGN PATENT DOCUMENTS

| | | | |
|---|---|---|---|
| JP | 404371521 | * 12/1992 | ..... 149/593 |
| JP | 10-137850 | 5/1998 | |
| JP | 2001-329316 | 11/2001 | |

* cited by examiner

*Primary Examiner*—Deborah Yee
(74) *Attorney, Agent, or Firm*—Clark & Brody

(57) ABSTRACT

Cold finished seamless steel tubes are made such that the residual stress F to be generated at the stage of the correction process after cold working is controlled to be 30 MPa or more and the scattering thereof is 30 MPa or less, when measured by Crampton method. Further, by adjusting the average grain size of spheroidized carbides, the dimensional change which emerges in lathe turning of the outside and inside diameter of relevant steel tubes due to the residual strain can be suppressed, and the strict roundness as well as the excellent machinability can be secured at the final processing stage of the work pieces for bearing parts. Consequently, steel tubes with high dimensional accuracy and less dimensional change at the final steps such as lathe turning, heat treatment and the like, can be made for use as bearing parts.

4 Claims, 3 Drawing Sheets

COLD FINISHED SEAMLESS STEEL TUBES

BACKGROUND OF THE INVENTION

1. Field of the Invention

The present invention relates to the cold finished seamless steel tubes for use of bearing parts such as the retainer ring and the like, more particularly to the same, wherein the dimensional change emerged due to the residual strain at the stage of lathe turning of the outside and inside diameter of the relevant steel tubes is significantly small, and the excellent roundness as well as the superior machinability at the final processing stage of bearing parts are reliably secured.

2. Description of the Related Art

Normally, the seamless steel tubes which require high dimensional accuracy undergo cold working process for precise finish to the targeted outside diameter and wall thickness by either drawing through dies or pilger rolling, subsequent to hot working process by either Mannesmann method, Extrusion method or others being followed on by softening treatment such as spheroidizing anneal and the like.

Accordingly, in-process seamless steel tubes after cold working process are softened by annealing and the like, then subjected to correction process for straightening and securing highly round shape of cross section thereof, and subsequently undergo the inspection for final tube products to be shipped out. The correction process after cold working process is applied to straighten the bend generated in annealing and to rectify the oval-like cross section caused by annealing into round one, by usually utilizing multi-roller straightener or by 2-roll straightener.

The cold finished seamless steel tubes thus shipped out are cut into ring-like work pieces, then are subjected to lathe turning and polishing for the predetermined dimension to be widely used for bearing parts of various equipment, of which the representative examples in use are the retainer ring and the like of the bearing.

When the work pieces for bearing parts are produced by aforementioned cold finishing, the common processing steps from billets to final bearing products are exemplified by the following: hot working process→spheroidizing annealing→cold working process→softening anneal→correction process→mill inspection for shipping→cutting of tubes→lathe turning→quench and temper (heat treatment)→polishing→assembling.

Meanwhile, the steel tubes made by said processing steps generally entail the residual stress due to correction process after cold working and intrinsically come to hold the residual strain in themselves. Accordingly, the thin wall steel tubes that the outside diameter is 70 mm or more and the ratio of the wall thickness to the outside diameter is 10% or less, at the stage of the machining process such as cutting and lathe turning as well as at the stage of quenching as for final heat treatment, are likely to lose the roundness owing to said residual stress, consequently resulting in the dimensional nonconformance.

In case the marked residual stress should exist, the large deformation due to the relevant residual strain is generated, which causes the frequency of polishing operation for dimensional correction to increase significantly, and or arouse the problem of failing in dimensional correction by polishing because of excessive deformation.

In order to cope with these problems, various proposals are made up to this time. For instance, the Japanese Patent Application (Laid-open) Publication No. 10-137850 describes the correction process of seamless steel tubes made by Ugine-Sejournet method for leaving low residual strain by applying an optimal condition such that the electric current of the load onto the upper and lower roll in 2-roll line contact type straightening machine is controlled.

Further, the Japanese Patent Application (Laid-open) Publication No. 2001-329316 discloses that, in order to remove the residual stress built up by the correction process, the annealing is carried out at 520° C. to 630° C. and the marginal correction process by using 2-roll air bend type straightener is applied such that the offset and the crush are controlled at 5 mm or less, and 1.5 mm to 5 mm respectively, which enables to obtain the hot finished seamless steel tubes with less dimensional change at the stage of machining.

Whist, as the high demand for cost reduction in manufacturing bearing parts is recently increased, it is required to reduce the margin of machining in the step of finishing of the work pieces and to secure much more round tubes than ever. And then, the problem arises that the previous proposals above are not adequate to meet these requirements.

SUMMARY OF THE INVENTION

As aforementioned, since the better dimensional accuracy and the superior surface finish at the final finishing stage are required to cope with the reduction of the machining margin for the seamless steel tubes to be used for bearing parts, it has become impossible for those hot finished seamless steel tubes described in the Japanese Patent Application (Laid-open) Publication Nos. 10-137850 and 2001-329316 to meet the desired accuracy and surface finish and to live up to the requirements as a whole.

Furthermore, since the strict roundness becomes necessary as bearing parts and the tube making process which results in as small deformation as possible at the final processing stage are sought after, the new countermeasure to respond to these requirements are to be developed in manufacturing process of Bearing Steel Tubes. Meanwhile, it is also necessary to further investigate to secure the good machinability in processing of the work pieces for bearing parts.

In consideration of above problems to date, the present invention is made and its object is to provide the cold finished seamless steel tubes for use of bearing parts such as the retainer rings and the like, which not only contributing to reduce the manufacturing cost of bearing parts but also having high dimensional accuracy along with very little deformation at the final processing stage such as lathe turning, heat treatment and the like.

To solve above problems, the inventors precisely investigated about the deformation generated in lathe turning of seamless steel tubes for bearing parts as well as in subsequent quench hardening treatment, and paid attention to the residual stress caused by correction process after cold working, and further the grain size of spheroidized carbides to affect the deformation in quench hardening.

While, the marked progress in the technology as to lathe turning of steel tubes is made such that, for instance, the 6-finger chuck enables highly precise machining, irrespective of the material grade or the size of the work pieces. However, in lathe turning of steel tubes in general, when the roundness of the work piece itself is not secured, the configuration after being released from chucking depends on the roundness of the work piece, occasionally resulting in way out-of-roundness cross section after machining the work piece according to the condition of the work piece.

When no residual stress exists, i.e. in case of "zero" residual stress, no deformation due to the strain generates in lathe turning. Whilst, in manufacturing the seamless steel tubes in general, the straightening operation is indispensable for correction of the bend and the cross section of in-process steel tubes. Therefore, it should be taken for granted that the residual stress to some extent should exist in steel tubes.

Moreover, since the lathe turning of steel tubes is perceived as a kind of destruction activity, the machinability of steel tubes can be improved by rendering the residual stress to be held in steel tubes themselves to some extent. In other word, by virtue of the residual strain in steel tubes themselves, the lathe turning thereof is efficiently carried out, and simultaneously the discharge of the machining chips can be facilitated. Thus, the extension of the machining tool life as well as the improvement of the machinability can be achieved.

Accordingly, it becomes very important for the generation of the residual stress to be controlled with the prerequisite that the residual stress to some extent shall be by any means generated in correction process after cold working. To be concrete, on the basis of rendering the residual stress to be built up in relevant steel tubes themselves, it is possible to decrease the deformation in lathe turning by controlling the scattering of the residual stress in relevant steel tubes.

The work pieces for bearing parts are subjected to heat treatment such as oil quenching and the like after lathe turning for obtaining high mechanical properties so as to secure wear resistance. But, when the larger deformation in association with quenching operation is generated, it becomes impossible for the work pieces to be charged into polishing line, and the circumstance that the grinding step as rectification operation be added shall arise. What is worse, in case the excessive deformation is present, the polishing step is not able to secure the expected configuration as final products, resulting in the dimensional nonconformance.

In the meantime, before quenching is carried out after lathe turning, the carbides in the microstructure of steel tubes have to be uniformly dissolved in the matrix, otherwise uneven quench hardening takes place in circumferential direction of steel tubes and the deformation appears as quenching advances. Hence, in order to suppress the generation of the deformation in quenching, it is essential to get carbides dissolved uniformly before quenching. And to that end, it is effective to homogenize the average grain size of the carbides.

The present invention is made on the basis of above findings, and the gist thereof is shown in the following (1) or (2), either of which stipulates the feature of the cold finished seamless steel tubes independently.

(1) Cold finished seamless steel tubes, wherein the residual stress measured by Crampton method shown by Equation (i) is 30 MPa or more, and the scattering thereof is 30 MPa or less.

$$F=E\cdot(1/D-1/D')\cdot t/(1-\nu^2) \quad \text{(i)}$$

Where

E: Young's modulus (MPa)

ν: Poisson's ratio

D: Outside diameter of test specimen before axial slitting (mm)

D': Outside diameter of test specimen after axial slitting (mm)

t: Average wall thickness of test specimen (mm)

(2) It is preferable that, for the cold finished seamless steel tubes according to above (1), an average grain size of spheroidized carbides in the microstructure be controlled between 0.35 μm and 0.70 μm. It is more preferable that, for those tubes mentioned above, in order to suppress the scattering of the residual stress in relevant steel tubes themselves, cold drawing as cold working process be adopted.

According to the cold finished seamless steel tubes in above (1) or (2), by controlling the residual stress to be generated in correction process after cold working, and, when in need, by adjusting the average grain size of spheroidized carbides, the dimensional change which emerges in lathe turning of the outside and inside diameter of relevant steel tubes due to the residual strain can be suppressed to be small, and thus the strict roundness as well as the excellent machinability can be secured at these processing stage of the work pieces for bearing parts. Consequently, the present invention can contribute to cost reduction for bearing parts and can provide relevant steel tubes with less dimensional change at the final steps such as lathe turning, heat treatment and the like, to be used for bearing parts such as retainer rings and the like.

DETAILED DESCRIPTION OF THE PREFERRED EMBODIMENTS

The present invention does not intend to set the specific limitation for the chemical composition of the blank material to be used for bearing parts, but it is preferable that High Carbon Chromium Type Bearing Steel such as SUJ2 specified in JIS G 4805 and the like is used.

The seamless steel tubes which the present invention specifies are made as follows: tube blanks are firstly made by hot working such as Mannesmann rolling method or Ugine-Sejournet extrusion method to the predetermined dimension, followed by spheroidizing annealing for softening purpose, and then are subjected to cold working process such as cold drawing, cold pilger rolling and the like. Further, subsequent to such cold working process for precise finish to the target dimension, the softening treatment such as annealing and the like is performed, and the straightening operation by multi-roll straightener or 2-roll straightener follows on.

Figure 1:
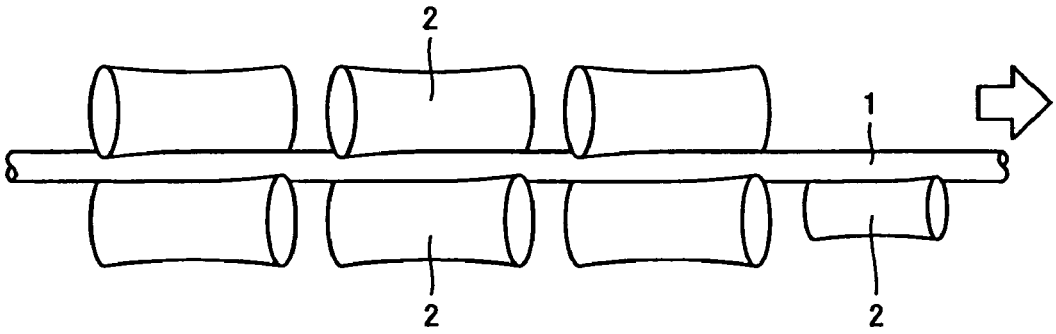
FIG. 1 is a diagram to show the 2-2-2-1 type paired cross roll as an example of the constitution of 2-roll straightener.

FIG. 1 is a diagram to show the 2-2-2-1 type paired cross roll as an example of constitution of 2-roll straightener, wherein the paired rolls 2 with their axes inclined & crossed rotate in the same direction, and relevant steel tubes 1 between said rolls 2 are straightened by virtue of given bending moment while rotating. In 2-roll straightener, the crush (mm) and the offset (mm) are accordingly selected as parameters for correction process.

For instance, in case that the straightening operation is performed in the 2-2-2-1 type paired cross roll, the crush Lc (mm) and the offset Lo (mm) as given by Equations (ii) and (iii) respectively are selected as the initial target parameters. Thus, by controlling the straightening parameters in accordance with Equations (ii) and (iii) in 2-roll straightener, where D (mm) designates the outside diameter of steel tubes and t (mm) does the wall thickness thereof, the straightening of the bend as well as the control of the residual stress can be achieved while maintaining the roundness of the cross section, consequently enabling to obtain the cold finished seamless steel tubes which show less dimensional change at the stages of lathe turning and quenching operation of the work pieces for bearing parts.

$$Lc=0.005\times D+2.3+0.01\times t \quad \text{(ii)}$$

$$Lo=-0.06\times D+17.4 \quad \text{(iii)}$$

On the other hand, the multi-roll straightener, though not shown as a diagram, is constituted by 3 rolls or more, wherein each roll is alternately disposed so as to provide bending by repeatedly reversing in direction without rotation of the relevant tube and the straightening operation is performed by adjusting the offset (mm) only.

Normally, the bend of steel tubes as final products is controlled within 1 mm/1000 mm by the straightening operation using either multi-roll straightener, 2-roll straightener or others.

The measuring method of the residual stress for cold finished seamless steel tubes according to the present invention is Crampton method, because the circumferential residual stress of thin wall steel tubes can be accurately measured by said method.

Figure 2A:
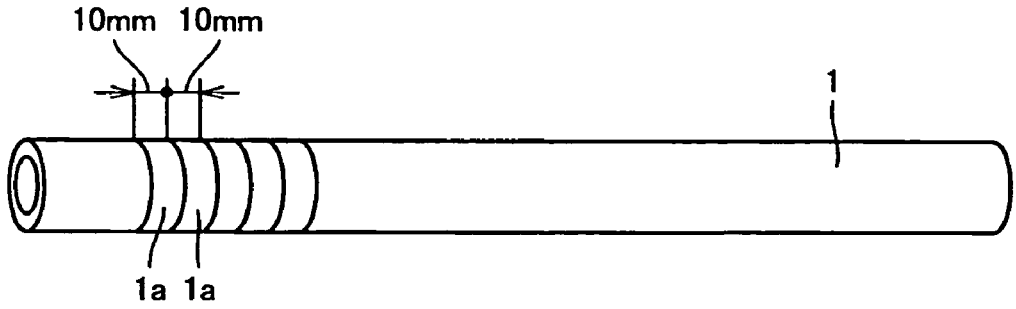
FIG. 2A shows the location of sampling the ring-like specimen in axial length of the relevant steel tube, FIGS. 2B and 2C respectively show the specimen before and after axial slitting being made.
Figure 2B:
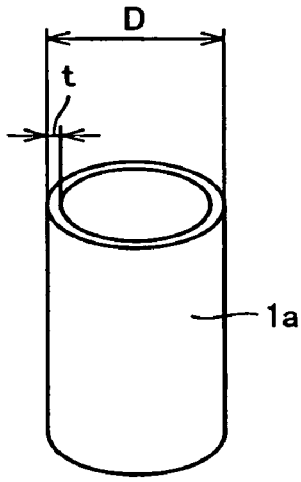
FIG. 2 are illustrations to explain how the test specimen is prepared in Crampton Method, where
Figure 2C:
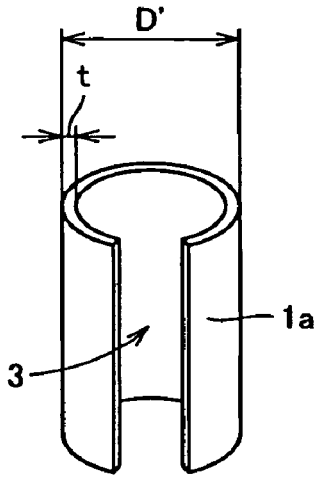

FIG. 2 are diagrams to show sampling procedure of test specimens for Crampton methods, wherein FIG. 2A indicates the location of ring-like test specimens to be sampled in axial length of the relevant tubes, while FIGS. 2B and 2C indicate the configuration of the test specimen before and after making an axial slit respectively. As the leading top ends of the steel tubes in straightening operation are likely to get damaged/deformed by the impact in feeding into rolls, 4 to 10 pieces of ring-like test specimens 1*a* with 10 mm width each are cut in ring and sampled in series from the location other than the leading top end of the relevant steel tube 1. The circumferential position of the sampled test specimen 1*a* is aligned, and cut opened axially to make the axial slit 3.

As shown in FIG. 2B, the outside diameter D and the wall thickness t of test specimen 1*a* before making an axial slit are measured. Next, after making an axial slit, the outside diameter D' of test specimen 1*a* at the position which is orthogonal to the position of the slit is measured. And then, by Equation (i), the residual stress F is calculated, where E (MPa) designates Young's modulus and ν designates Poisson's ratio.

$$F=E\cdot(1/D-1/D')\cdot t/(1-\nu^2) \quad \text{(i)}$$

According to the present invention, the measured residual stress F shall be 30 MPa or more, and the scattering thereof shall be 30 MPa or less.

The reason why the residual stress F existing in steel tubes themselves is specified to be 30 MPa or more is that the constant residual strain therein help secure the good machinability as bearing steel Tubes. As aforementioned, as the machining is a kind of destruction activity, the machinability along with the extension of the tool life is to be improved by the reaction of the internal strain, by securing the residual stress as 30 MPa or more.

The present invention further specifies that the scattering of the residual stress is controlled to be 30 MPa or less. That is, although the residual stress of the relevant steel tube is 30 MPa or more, the dimensional change emerging at the stage of lathe turning for bearing parts can be minimized by controlling the scattering itself of the residual stress existing in each steel tube to be 30 MPa or less. Thus, the margin of the machining can be reduced, and the polishing process can be simplified.

It is preferable that the average grain size of the spheroidized carbides in the microstructure of the seamless steel tubes according to the present invention stay in the range from 0.35 μm to 0.70 μm. As aforementioned, before quenching is carried out after lathe turning, the carbides in the microstructure of steel tubes have to be uniformly dissolved in the matrix, otherwise uneven quench hardening takes place in circumferential direction of steel tubes and the deformation appears as quenching advances.

When the average grain size of the spheroidized carbides is too coarse or too fine, the roundness of steel tubes gets worse although the reason is not clarified. Accordingly, the present invention specifies the average grain size of the spheroidized carbides depending on the necessity.

According to the present invention, either cold drawing or cold pilger rolling as cold working process can be applied. However, it is preferable that cold drawing which uses a die-with-hole is applied to satisfactorily suppress the scattering of the residual stress for each tube.

Thus, when cold drawing is applied as cold working process, it is recommendable to use the die-with-hole having 20 degrees to 25 degrees of an approach angle to a bearing portion thereof, because the usage of the die with the approach angle other than this might generate the large scattering of the residual stress.

EXAMPLES

In the following, the effect to be exhibited by the cold finished seamless steel tubes according to the present invention is concretely described by Example 1 and 2.

Example 1

The steel with the chemical composition shown in Table 1 is melted to be the steel blank for SUJ2 Bearing Steel specified in JIS G 4805. By hot working, this steel blank is transformed into the tube blank for cold working process, which is subsequently subjected to spheroidizing anneal, and followed by cold working process. After cold working process, an annealing for softening purpose is carried out and the straightening operation follows on for obtaining the relevant sample of the steel tubes.

TABLE 1

Chemical composition of sample steel tubes (mass %)

| | | | | | | Balance: Fe and impurities | | |
|---|---|---|---|---|---|---|---|---|
| C | Si | Mn | P | S | Cr | Cu | Ni | Mo |
| 1.00 | 0.23 | 0.33 | 0.008 | 0.005 | 1.38 | 0.01 | 0.02 | 0.01 |

Mannesmann Mandrel Mill as hot working process is applied to obtain the tube blanks for cold working process, the outside diameter of which are 38 mm to 110 mm and the wall thickness are 3.1 mm to 6 mm, subsequently being cooled down in air after hot working process. Each tube blank is subjected to spheroidizing annealing, descaling by normal acid pickling and surface preparation/lubrication in series, followed by cold drawing according to the pass schedule shown in Table 2 to obtain the cold finished steel tubes with 30 mm to 100 mm of outside diameter and 2.5 mm to 5 mm of wall thickness. The section area reduction rate in cold drawing is 25% to 36%.

In above cold drawing, the taper type opening configuration die along with either the tapered or the cylindrical plug is used. The approach angle of the die to be used is varied in the range of 10 degrees to 25 degrees as described in Table 3 to be shown later.

TABLE 2

Schedule of Cold Drawing

| Dimension of Tube Blank (Outside Diameter × Wall Thickness) (mm) | Dimension of Cold Finished Tube (Outside Diameter × Wall Thickness) (mm) | Section Area Reduction Rate |
|---|---|---|
| 95 × 6 | 85 × 6 | 25% |
| 110 × 4.8 | 100 × 3.5 | 33% |
| 83 × 6 | 70 × 5 | 30% |
| 60 × 5.8 | 50 × 4.5 | 35% |
| 38 × 3.1 | 30 × 2.5 | 36% |

Subsequent to cold working process, the annealing for softening and then straightening operation are carried out, followed by the inspection of the characteristic of the finished steel tubes. In Example 1, the annealing condition is 680° C. of average holding temperature with duration of 20 minutes. The straightening operation is carried out by using 2-2-2-1 paired cross roll sraightener, whereby the amounts of the crush and the offset are varied for each sample of steel tubes. Those parameters are shown in Table 3.

sampled in series from the relevant sample of steel tubes. The circumferential position of each test specimen is arranged in the same axial direction and those test specimens are aligned in the prior axial position of the length before cutting in ring. By axial slitting, the circumference length of the test specimen is partially removed. Inserting the data such as the measured outside diameter D' of the test specimen after making the axial slit at the position which is orthogonal to the position of the axial slit, and the outside diameter D along with the wall thickness t of test specimen before making the axial slit, into Equation (i) as below, the residual stress F is calculated, where E (MPa) designates Young's modulus and ν designates Poisson's ratio.

$$F=E\cdot(1/D-1/D')\cdot t/(1-\nu^2) \quad \text{(i)}$$

Further, the ring test specimen above is provided for Scanning Electron Microscope to measure the average spheroidized carbides. In Table 3, the maximum and minimum value with respect to the residual stress and its scattering to be obtained by subtracting the minimum value from the maximum one are shown along with the average grain size of spheroidized carbides.

Meanwhile, the lathe turning of the outside and inside diameter with the machining margin of 0.2 mm to 0.3 mm each is carried out for those ring test specimens without slitting, and the roundness of each specimen is measured subsequently. Then, oil quenching at 830° C.×30 min. is performed and the roundness is measured again. Hereby, the roundness (mm) is obtained by subtracting the minimum value from the maximum value with respect to the outside diameter.

TABLE 3

| | Cold Drawing | | | | | | | | | | |
|---|---|---|---|---|---|---|---|---|---|---|---|
| | | | Straightening | | Measured Residual Stress F (MPa) | | | | | | |
| Test No. | Dimension of Cold Finished Tube (Outside Diameter × Wall Thcikness) (mm) | Approach Angle of Die | Crush (mm) | Offset (mm) | Maximum (F max) | Minimum (F min) | Scattering (F max − F min) | Average Grain Size of Spheroidized Carbides (μm) | Roundness after Lathe Turning (mm) | Roundness after Quenching (mm) | Remarks |
| 1 | 85 × 5 | 25° | 2.7 | 12 | 85 | 72 | 13 | 0.48 | 0.06 | 0.08 | Inventive Example |
| 2 | 100 × 3.5 | 25° | 2.9 | 11 | 112 | 90 | 22 | 0.51 | 0.10 | 0.12 | Inventive Example |
| 3 | 70 × 5 | 25° | 2.7 | 13 | 86 | 68 | 18 | 0.45 | 0.10 | 0.09 | Inventive Example |
| 4 | 50 × 4.5 | 25° | 2.6 | 15 | 64 | 54 | 10 | 0.42 | 0.05 | 0.05 | Inventive Example |
| 5 | 30 × 2.5 | 25° | 2.4 | 17 | 40 | 31 | 9 | 0.39 | 0.02 | 0.03 | Inventive Example |
| 6 | 85 × 5 | 25° | 2.7 | 1 | — | — | — | 0.46 | — | — | # |
| 7 | 85 × 5 | 25° | 4.0 | 12 | 170 | 128 | *42 | 0.44 | 0.31 | 0.32 | Comparative Example |
| 8 | 85 × 5 | 10° | 2.7 | 12 | 83 | 45 | *38 | 0.40 | 0.25 | 0.24 | Comparative Example |

Note:
(1) *designates the deviation from the range specified in the present invention.
(2) # in the column of Remarks indicates that, as the bend after straightening is 2 mm/1000 mm, the ring test specimens cannot be prepared.

As the residual stress F after the straightening operation is measured by Crampton method, 4 to 10 pieces of ring-like test specimens with 10 mm width each are cut in ring and From the result shown in Table 3, it is noted that the inventive examples (Test Nos. 1 to 5), in which the residual stress F is 30 MPa or more and its scattering is 30 MPa or less, show the good machinability along with the superior roundness like 0.12 mm or less after quenching operation.

On the other hand, the comparative examples (Test Nos. 7 and 8), in which the scattering of the residual stress F is 38 MPa to 42 MPa, exhibit the poor roundness like 0.24 mm to 0.32 mm after quenching operation.

Meanwhile, as the applied offset is as small as 1 mm in Test No. 6, the large bend like the bow remains as bad as 2 mm/1000 mm, which makes it impossible to prepare the ring test specimens and to measure the residual stress and the roundness after quenching operation.

Example 2

Similarly to Example 1, the steel with the chemical composition shown in Table 1 is melted to be the steel blank for SUJ2 Bearing Steel specified in JIS G 4805. By hot working process, this steel blank is transformed into the tube blank for cold working process.

type opening configuration die along with the cylindrical plug is used, and the approach angle of the die is 25 degrees.

And the annealing for softening is performed with the condition that the average holding temperature is 680° C. with duration of 20 minutes. In the inspection step after the straightening operation, the same procedure as Example 1 is adopted to measure the residual stress along with the average grain size of the spheroidized carbides. Further, the lathe turning of the outside and inside diameter with the machining margin of 0.2 mm to 0.3 mm each is carried out for those ring-like test specimens, and the roundness of each specimen is measured subsequently. Then, oil quenching with the condition of 830° C.×30 min. is performed and the roundness is measured again.

Table 4 shows the schedule of cold drawing and the straightening parameters along with the measured data of the residual stress F, the average grain size of the spheroidized carbides and the roundness.

TABLE 4

| | Cold Drawing | | | | | | | | | | |
|---|---|---|---|---|---|---|---|---|---|---|---|
| | Dimension of Cold Finished Tube (Outside Diameter × Wall Thcikness) (mm) | Approach Angle of Die | Straightening Crush (mm) | Straightening Offset (mm) | Measured Residual Stress F (MPa) Maximum (F max) | Measured Residual Stress F (MPa) Minimum (F min) | Scattering (F max − F min) | Average Grain Size of Spheroidized Carbides (μm) | Roundness after Lathe Turning (mm) | Roundness after Quenching (mm) | Remarks |
| Test No. | | | | | | | | | | | |
| 9 | 85 × 5 | 25° | 2.7 | 12 | 85 | 72 | 13 | 0.48 | 0.07 | 0.08 | Inventive Example |
| 10 | 85 × 5 | 25° | 2.7 | 12 | 89 | 69 | 20 | 0.31 | 0.13 | 0.22 | Inventive Example |
| 11 | 85 × 5 | 25° | 2.7 | 12 | 84 | 73 | 11 | 0.81 | 0.10 | 0.21 | Inventive Example |

Figure 3:
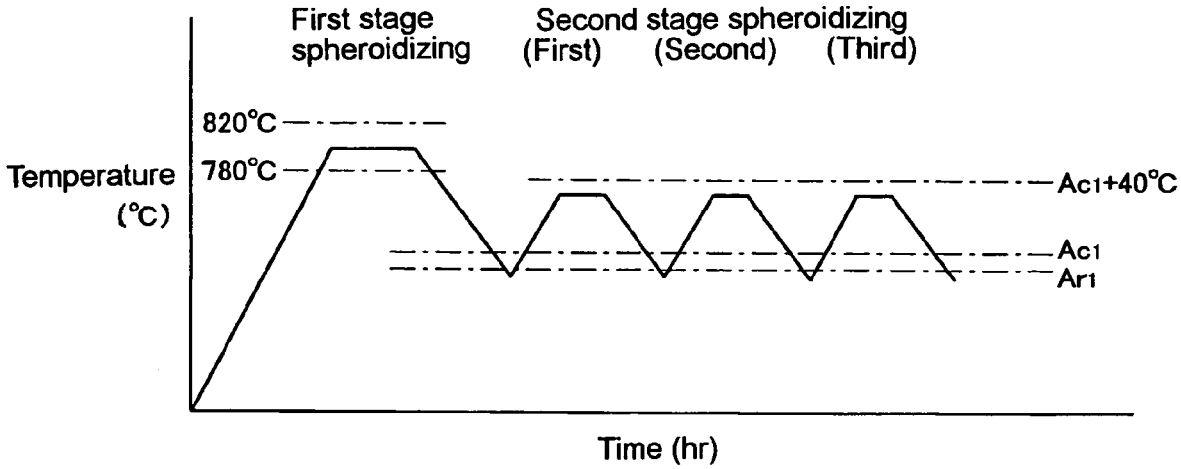
FIG. 3 shows the heat pattern of spheroidizing annealing which is applied for Example 2.

FIG. 3 shows the heat pattern of the spheroidizing annealing which is applied in Example 2. The said pattern comprises by two stages: the first stage spheroidizing such that the holding temperature is 780° C. to 820° C. and the subsequent cooling rate to the temperature below Ar1 is controlled to be 50° C./hr to 200° C./hr; the second stage spheroidizing in succession such that, after heating to above Ac1 but not greater than the temperature of Ac1 plus 40° C. and holding, the cooling is made to the temperature of Ar1 or under with the cooling rate of 50° C./hr to 200° C./hr, wherein the second stage spheroidizing are repeated three times or more.

Whilst, by controlling the pattern of spheroidizing annealing, the steel tubes with various grain sizes of carbides are made. Then, cold working process, annealing for softening and straightening are applied to make the relevant samples of steel tubes.

Mannesmann Mandrel Mill as hot working process is applied to obtain the tube blanks for cold working process, the outside diameter of which is 95 mm and the wall thickness is 6 mm, subsequently being cooled down in air after hot working process. Each tube blank is subjected to spheroidizing annealing of which the heat pattern is controlled, descaling by normal acid pickling and surface preparation/lubrication in series, followed by cold drawing with 25% of the section area reduction rate to obtain the cold finished steel tubes with 85 mm of the outside diameter and 5 mm of the wall thickness. Similarly to Example 1, taper From the result shown in Table 4, it is noted that, in case the residual stress F is 30 MPa or more and the roundness after lathe turning is satisfactory, the roundness after oil quenching slightly gets worse like 0.21 mm to 0.22 mm unless the average grain size of the spheroidized stays in the range from 0.35 μm to 0.70 μm (Test Nos. 10, 11).

The cold finished seamless steel tubes according to the present invention are made such that the residual stress F to be generated at the stage of the correction process after cold working is controlled to be 30 MPa or more and the scattering thereof is 30 MPa or less, when measured by Crampton method. Further, when in need, by adjusting the average grain size of spheroidized carbides, the dimensional change which emerges in lathe turning of the outside and inside diameter of relevant steel tubes due to the residual strain can be suppressed to be small, and the strict roundness as well as the excellent machinability can be maintained at the final processing stage of the work pieces for bearing parts. Consequently, the present invention can contribute to cost reduction for bearing parts and can provide relevant steel tubes with high dimensional accuracy and less dimensional change at the final steps such as lathe turning, heat treatment and the like, which can be widely used as bearing steel tubes for various industrial machines.

What is claimed is:

1. A cold finished seamless steel tube, wherein a bend in the tube is less than 2 mm/1000 mm and the residual stress F of the tube thereof to be measured by Crampton method (obtained by Equation (i) as below) is 30 MPa or more and its scattering is 30 MPa or less.

$$F=E\cdot(1/D1/D')\cdot t/(1-v^2) \quad \text{(i)}$$

Where

E: Young's modulus (MPa)

v: Poisson's ratio

D: Outside diameter of test specimen before making an axial slit (mm)

D': Outside diameter of test specimen after making an axial slit (mm)

t: Average wall thickness of test specimen (mm).

2. The finished seamless steel tube as claimed in claim 1, wherein an average grain size of the spheroidized carbides in the microstructure stays in the range from 0.35 μm to 0.75 μm.

3. The finished seamless steel tube as claimed in claim 1, wherein cold drawing as cold working process is applied.

4. The finished seamless steel tube as claimed in claim 2, wherein cold drawing as cold working process is applied.

* * * * *